US010934118B1

(12) United States Patent
Bates, III

(10) Patent No.: US 10,934,118 B1
(45) Date of Patent: Mar. 2, 2021

(54) ASSEMBLY FOR DISPENSING SHEETING FROM A ROLL

(71) Applicant: Joseph W. Bates, III, Noblesville, IN (US)

(72) Inventor: Joseph W. Bates, III, Noblesville, IN (US)

( * ) Notice: Subject to any disclaimer, the term of this patent is extended or adjusted under 35 U.S.C. 154(b) by 121 days.

(21) Appl. No.: 16/058,489

(22) Filed: Aug. 8, 2018

Related U.S. Application Data

(60) Provisional application No. 62/542,882, filed on Aug. 9, 2017.

(51) Int. Cl.
*B65H 16/00* (2006.01)
*B65H 16/06* (2006.01)

(52) U.S. Cl.
CPC ..... *B65H 16/005* (2013.01); *B65H 16/06* (2013.01); *B65H 2402/42* (2013.01)

(58) Field of Classification Search
CPC ... B65H 16/005; B65H 16/06; B65H 2402/42
See application file for complete search history.

(56) References Cited

U.S. PATENT DOCUMENTS 1,518,750 A * 12/1924 Meynardie ..... B65H 35/0006 225/38
2,994,939 A * 8/1961 Matthews ..... D02H 13/38 13/38
4,705,283 A * 11/1987 Kleisath ..... B65H 49/32 242/557
4,754,815 A * 7/1988 Brouwer ..... A01G 20/12 172/2
6,360,984 B1 * 3/2002 England ..... B65H 16/02 242/557
6,550,515 B2 * 4/2003 Lavelle ..... B65H 35/004 156/527
6,860,471 B2 * 3/2005 Albritton ..... B65H 49/32 140/108
7,530,522 B2 * 5/2009 Popp ..... B65H 16/02 242/396.5
2007/0210200 A1 * 9/2007 Popp ..... B65H 16/02 242/419.4
2017/0137254 A1 * 5/2017 Becker ..... B65H 75/425

* cited by examiner

*Primary Examiner* — William A. Rivera
(74) *Attorney, Agent, or Firm* — Stites & Harbison, PLLC; David W. Nagle, Jr.; James R. Hayne

(57) ABSTRACT

An assembly for dispensing sheeting from a roll comprises a main tube with a lower support extending from the main tube and configured to support the roll, and with an upper support extending from the main tube at a distance from the lower support. The lower support and the upper support secure opposite ends of the roll, such that the roll can rotate while sheeting is dispensed from the roll. In some embodiments, the assembly further includes one or more arms pivotally connected to the main tube and configured to partially enclose the roll and/or a securing member (or rod) configured to engage the roll along its length. In some embodiments, the assembly further includes a connection tube pivotally connected to the main tube and configured to removably attach the assembly to a vehicle.

18 Claims, 8 Drawing Sheets

ASSEMBLY FOR DISPENSING SHEETING FROM A ROLL

CROSS-REFERENCE TO RELATED APPLICATIONS

The present application claims priority to U.S. Provisional Patent Application Ser. No. 62/542,882 filed on Aug. 9, 2017, the entire disclosure of which is incorporated herein by reference.

TECHNICAL FIELD

The present invention relates to an assembly for dispensing sheeting, such as plastic sheeting, or similar flexible materials from a roll.

BACKGROUND OF THE INVENTION

During construction, sheeting is oftentimes applied along an exterior wall or roof. For example, plastic sheeting is applied to a wall to provide a vapor barrier. Typically, this plastic sheeting comes in large rolls with a width of eight or more feet and a length of tens to hundreds of feet. Unrolling the plastic sheeting from the roll and securing it to a wall can be difficult, especially when the plastic sheeting needs to be applied a significant distance above ground level.

SUMMARY OF THE INVENTION

The present invention is an assembly for dispensing sheeting, such as plastic sheeting, or similar flexible materials from a roll. The assembly is configured for removable attachment to a vehicle.

An exemplary dispensing assembly made in accordance with the present invention generally comprises a main tube and a connection tube that are pivotally connected approximately midway along each of their lengths by a rotating connector, or knuckle.

In some embodiments of the present invention, the connection tube has a fixed length, but the main tube has an adjustable length and includes a first (or upper) member and a second (or lower) member, which are slidably connected to one another.

In some embodiments of the present invention, the dispensing assembly further includes a lower support secured to and extending from the lower end of the main tube and an upper support secured to and extending from the upper end of the main tube opposite from the lower support. Each of the supports includes a post extending away from the respective support toward the opposite support. These posts are oriented substantially parallel to the main tube for securing opposite ends of a roll.

In some embodiments of the present invention, the dispensing assembly further includes one or more curved arms, each of which is pivotally connected to the main tube. Furthermore, a securing member (or rod) extends between the curved arms. Similar to the main tube, the rod is also adjustable in length. Specifically, the rod is comprised of a first (or upper) member and a second (or lower) member, which are slidably connected to one another. Each of the curved arms is connected to the main tube by a hinge, with a spring connected to and extending between the main tube and the curved arm to provide a biasing force. The curved arms are therefore capable of rotating between a closed position and an open position, with the springs biasing the curved arms toward the closed position. The lower support defines a channel adjacent to an outer periphery of the lower support, and the lower member of the rod extends through and is received in the channel. As the curved arms rotate, the lower member of the rod travels within the channel. Collars are preferably connected to the lower member of the rod, above and below the lower support, preventing the lower member of the rod from coming out of the channel.

In some embodiments of the present invention, a roller subassembly is operably connected to the lower support and is configured to support the weight of the roll of sheeting and facilitate rotation of the roll while dispensing the sheeting. In some embodiments, another roller is operably connected to the upper support; however, during use, the upper support and roller typically will not be supporting the weight of the roll of sheeting, and therefore, in some embodiments, no roller is included at the upper support at all.

In some embodiments of the present invention, the knuckle connecting the main tube and the connection tube includes a locking pin which, when inserted into the knuckle, maintains the alignment of the connection tube and the main tube relative to one another. Upon removing the locking pin, the main tube is free to rotate relative to the connection tube, for example, to allow for storage, loading/unloading of the roll of sheeting, or to provide for application of the sheeting to a sloped roof.

In operation, a user first attaches a dispensing assembly to a cherry picker or similar vehicle, and a roll of sheeting is then inserted into the dispensing assembly. In particular, the lower member of the main tube is released from the upper member of the main tube, allowing the main tube to expand to a length greater than the length of the roll. The roll is then positioned on the roller subassembly of the lower support, with the post at the lower support extending upward and into the center of the roll, and with the top of the roll aligned with the post extending from the upper support. Next, the upper support is moved into engagement with the other end of the roll, with the post extending downward and into the center of the roll. A locking pin is then inserted to secure the lower member of the main tube to the upper member of the main tube. The roll of sheeting is now supported by the lower support, with the roll resting on the roller subassembly, and the posts preventing removal of the roll. Furthermore, the springs provide a biasing force to move the curved arms and the securing member (rod) toward the closed position to partially surround or enclose the roll, with the rod engaging the roll along its length.

To dispense the sheeting, the dispensing assembly is raised to the appropriate height adjacent to the wall, and the free end of the sheeting is affixed to the wall. The dispensing assembly is then moved laterally along the wall, thus allowing the sheeting to dispense. In particular, as the dispensing assembly is moved away from the affixed end of the plastic sheeting, the roller subassembly allows the roll of plastic sheeting to rotate within the dispensing assembly while dispensing additional plastic sheeting from the roll. The curved arms and securing member (rod) prevent the plastic sheeting from unintentionally unwinding from the roll due to high winds, gravity, or the like, but still allow the roll to rotate and dispense plastic sheeting.

DESCRIPTION OF THE INVENTION

The present invention is an assembly for dispensing sheeting, such as plastic sheeting, or similar flexible materials from a roll. The assembly is configured for removable attachment to a vehicle, for example, a hydraulic crane with a distal platform (commonly referred to as a "cherry picker"). The assembly of the present invention allows a user to easily load a new roll of sheeting and unload an empty roll of sheeting, while also allowing the roll to rotate when dispensing the sheeting. Furthermore, in some embodiments, a securing member is used to keep the sheeting from unintentionally unwinding, for example, due to high winds.

Figure 1:
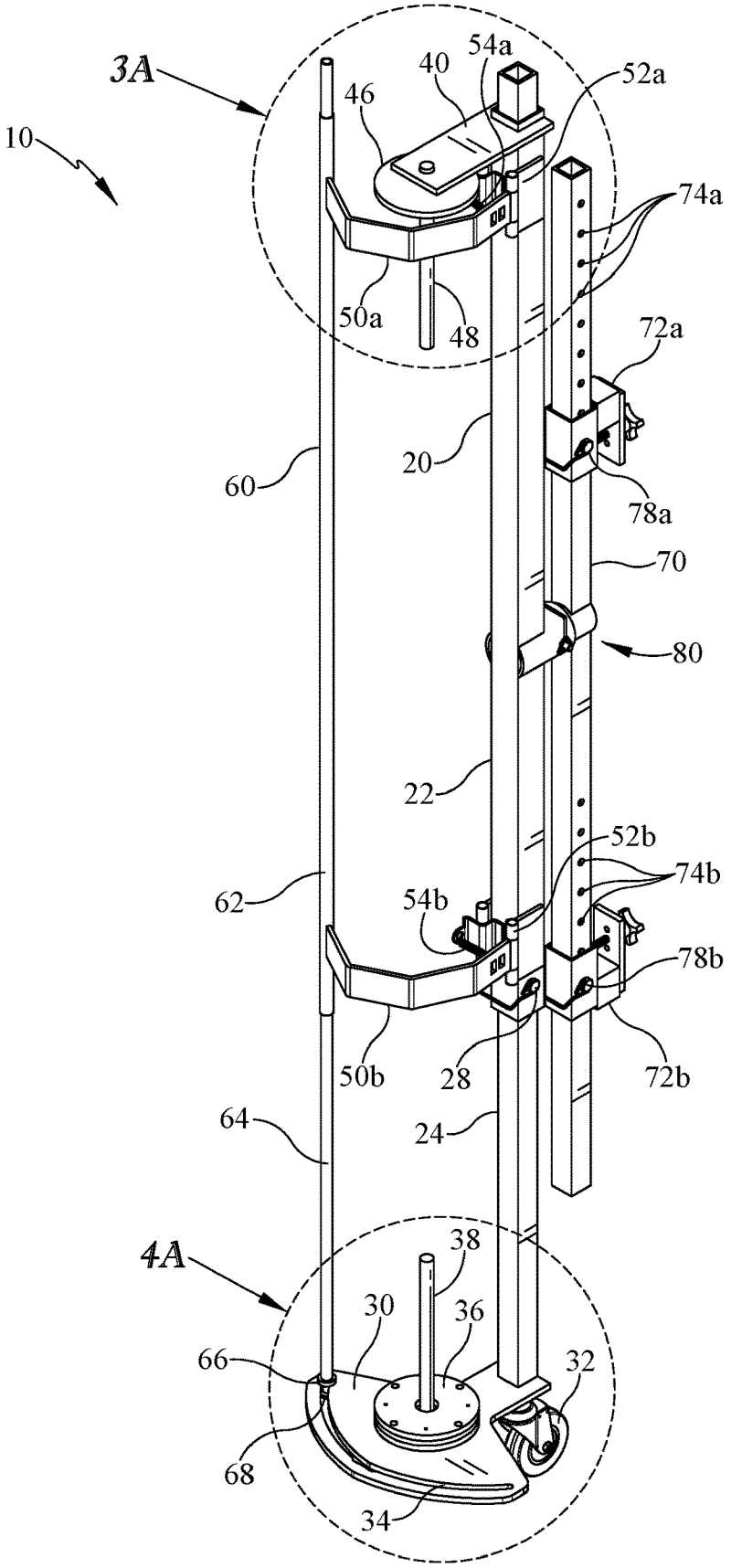
FIG. 1 is a front perspective view of an exemplary assembly for dispensing sheeting from a roll made in accordance with the present invention.
Figure 2:
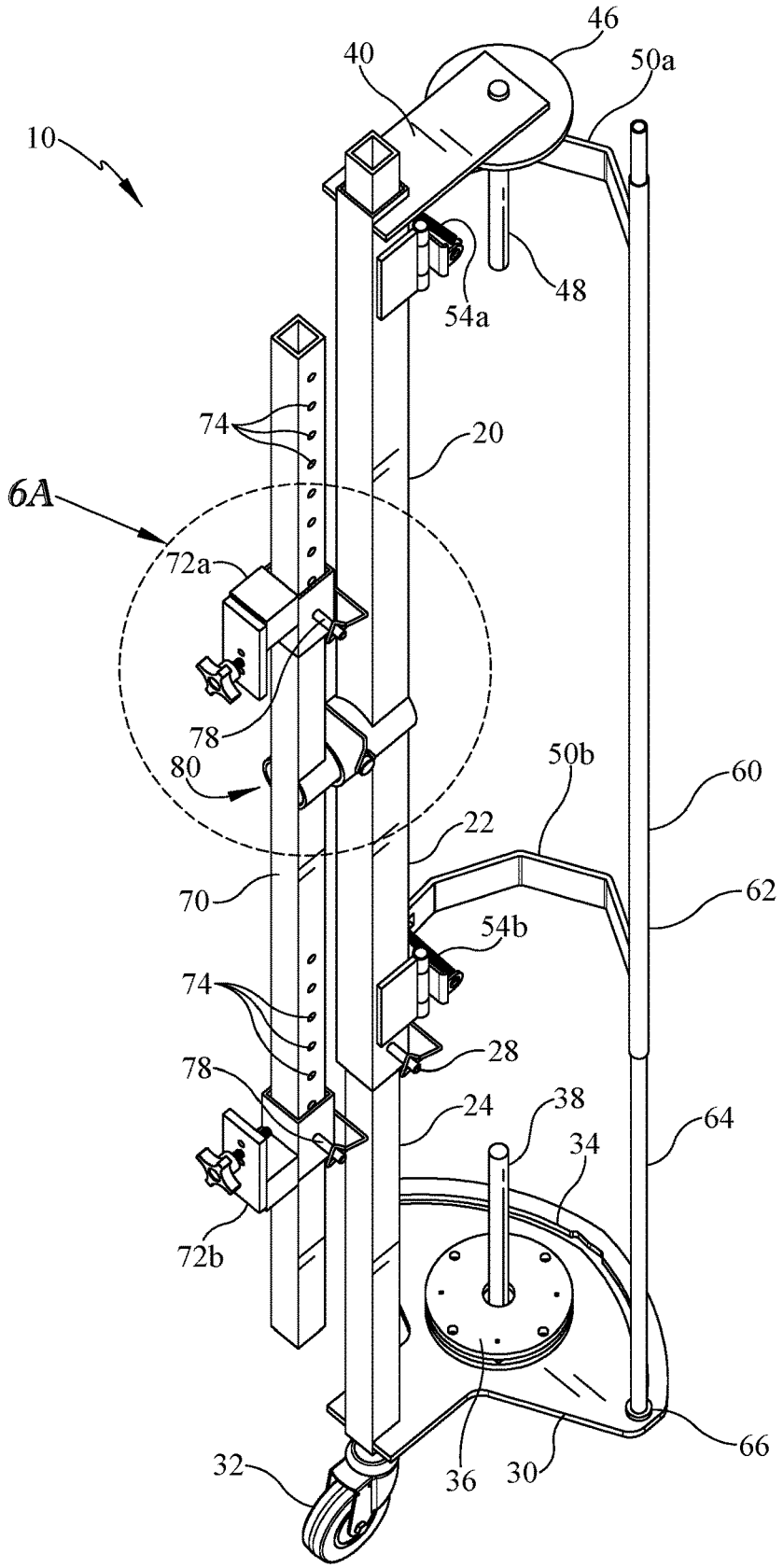
FIG. 2 is a rear perspective view of the exemplary assembly of FIG. 1.

Referring first to FIGS. 1 and 2, an exemplary assembly 10 for dispensing sheeting from a roll (which may also be referred to as a "dispensing assembly" in the description that follows) made in accordance with the present invention generally comprises a main tube 20 and a connection tube 70 that are pivotally connected to one another approximately midway along each of their lengths by a rotating connector (or knuckle) 80, as further described below.

Referring still to FIGS. 1 and 2, in this exemplary embodiment, each of the main tube 20 and the connection tube 70 is comprised of substantially hollow square tubing. The connection tube 70 has a fixed length, but the main tube 20 has an adjustable length. Specifically, the main tube 20 is comprised of a first (or upper) member 22 and a second (or lower) member 24, which are slidably connected to one another, as further described below with additional reference to FIG. 5.

Referring still to FIGS. 1 and 2, in this exemplary embodiment, the dispensing assembly 10 further includes a lower support 30 secured to and extending from the lower end of the main tube 20 and an upper support 40 secured to and extending from the upper end of the main tube 20 opposite from the lower support 30. In particular, the lower support 30 extends substantially perpendicularly from the lower member 24 of the main tube 20, and the upper support 40 extends substantially perpendicularly from the upper member 22 of the main tube 20. Each of the supports 30, 40 includes a post 38, 48 extending away from the respective support 30, 40 toward the opposite support 30, 40. These posts 38, 48 are oriented substantially parallel to the main tube 20 for securing opposite ends of a roll, as further described below.

Referring still to FIGS. 1 and 2, in this exemplary embodiment, the dispensing assembly 10 further includes first and second curved arms 50*a*, 50*b*, each of which is pivotally connected to the main tube 20. Although two curved arms 50*a*, 50*b* are included in this exemplary embodiment, fewer (one) or more curved arms could be incorporated into the dispensing assembly 10 without departing from the spirit and scope of the present invention. A securing member (or rod) 60 extends between the curved arms 50*a*, 50*b*, as further described below. Similar to the main tube 20, the rod 60 is also adjustable in length. Specifically, the rod 60 is comprised of a first (or upper) member 62 and a second (or lower) member 64, which are slidably connected to one another, as further described below with additional reference to FIG. 5.

Figure 3A:
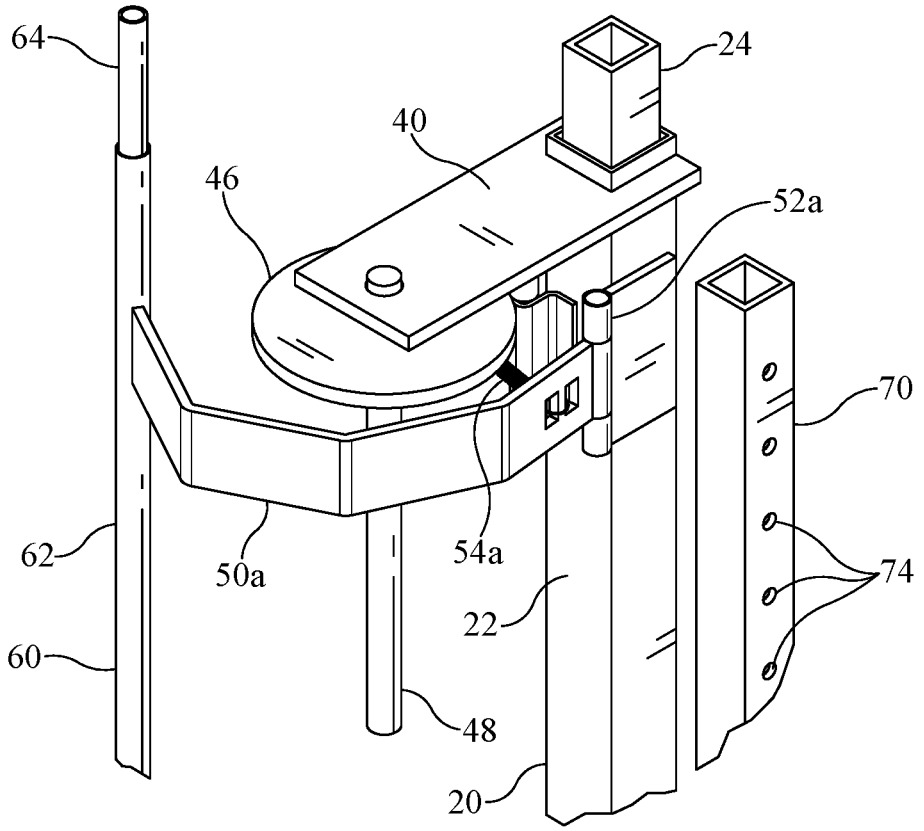
FIG. 3A is a partial enlarged view of an upper portion of the exemplary assembly of FIG. 1.
Figure 3B:
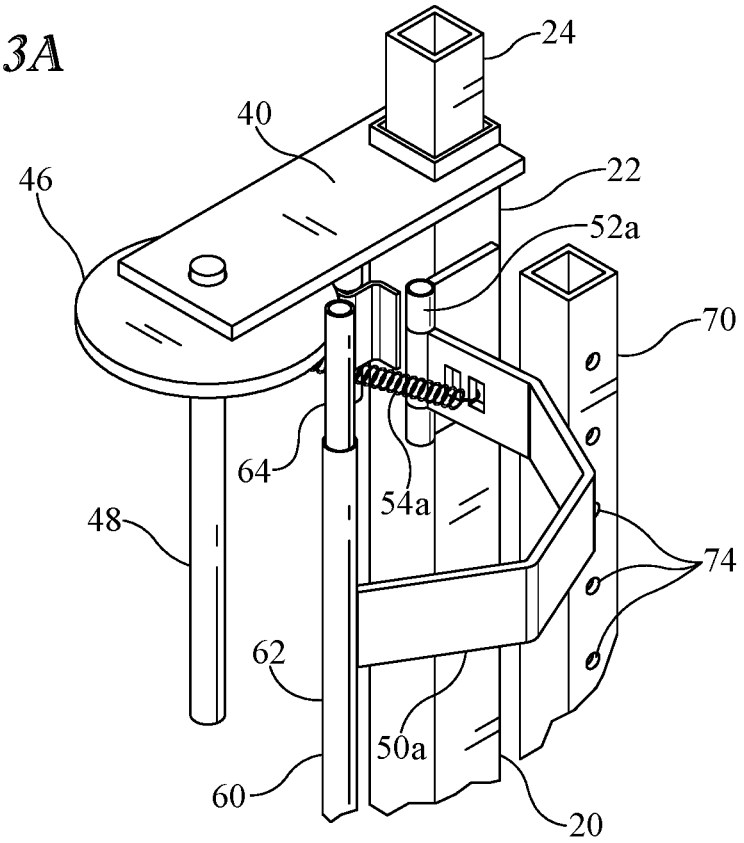
FIG. 3B is another partial enlarged view, similar to FIG. 3A, but with a securing member and a curved arm rotated into an open position.

Referring still to FIGS. 1 and 2, along with FIGS. 3A and 3B, the curved arm 50*a* is connected to the upper member 22 of the main tube 20 by a hinge 52*a*, with a spring 54*a* connected to and extending between the upper member 22 of the main tube 20 and the curved arm 50*a* to provide a biasing force. Although not shown in detail, the lower curved arm 50*b* is similarly connected to the main tube 20 by a hinge 52*b* with a spring 54*b*. The curved arms 50*a*, 50*b* are therefore capable of rotating between a closed position (shown in FIG. 3A) and an open position (shown in FIG. 3B), with the springs 54*a*, 54*b* biasing the curved arms 50*a*, 50*b* toward the closed position. As shown in FIGS. 3A and 3B, as the curved arms 50*a*, 50*b* rotate, the rod 60 moves with them.

Figure 4A:
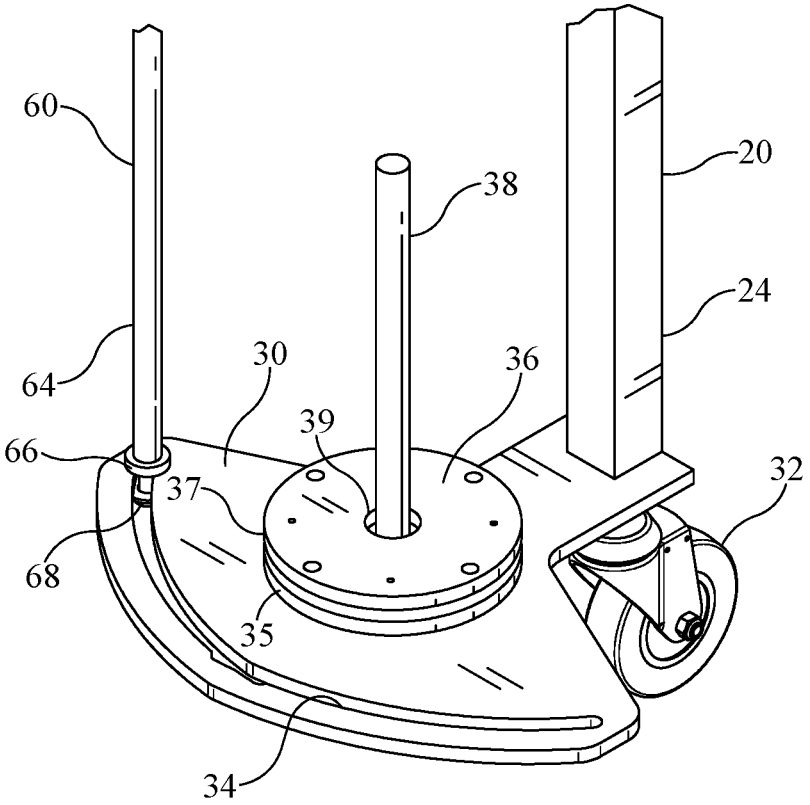
FIG. 4A is a partial enlarged view of a lower portion of the exemplary assembly of FIG. 1.
Figure 4B:
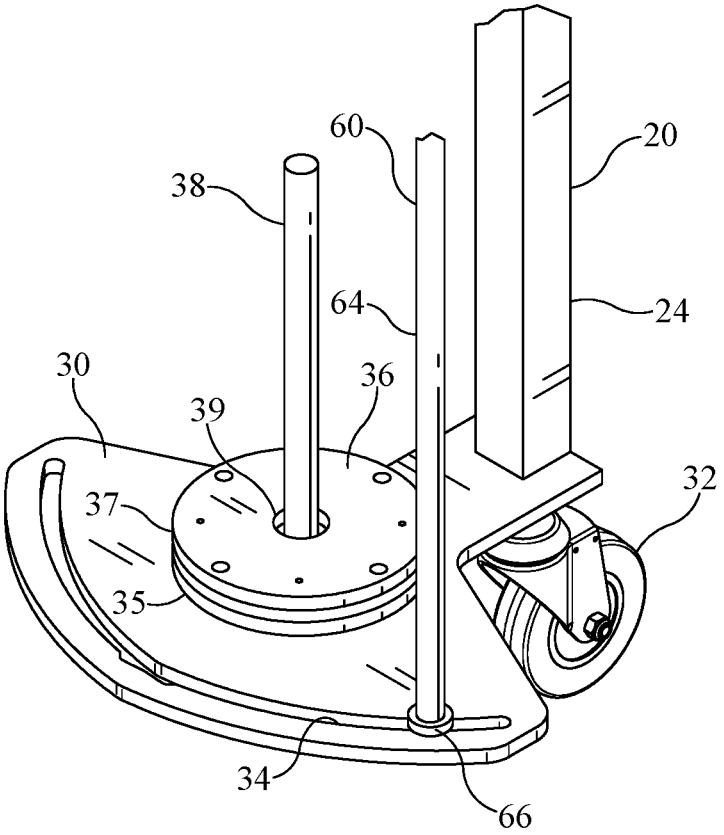
FIG. 4B is another partial enlarged view, similar to FIG. 4A, but with the securing member rotated into an open position.

Referring still to FIGS. 1 and 2, along with FIGS. 4A and 4B, the lower support 30 defines a channel 34 adjacent to an outer periphery of the lower support 30, and the lower member 64 of the rod 60 extends through and is received in the channel 34. As the curved arms 50*a*, 50*b* rotate, the lower member 64 of the rod 60 travels within the channel 34. In particular, when the curved arms 50*a*, 50*b* are in the closed position (shown in FIG. 3A), the rod 60 is similarly in a closed position (shown in FIG. 4A), and when the curved arms 50*a*, 50*b* are in the open position (shown in FIG. 3B), the rod 60 is similarly in an open position (shown in FIG. 4B). Furthermore, and as perhaps best shown in FIG. 4A, collars 66, 68 are preferably connected to the lower member 64 of the rod 60, above and below the lower support 30, preventing the lower member 64 of the rod 60 from coming out of the channel 34.

Referring still to FIGS. 1, 2, 4A, and 4B, a roller subassembly 36 is operably connected to the lower support 30, with the post 38 extending upward from the lower support 30 and through the roller subassembly 36. The roller subassembly 36 includes a lower plate 35 and an upper plate 37, with bearings (not shown) positioned between the lower plate 35 and the upper plate 37, so that the upper plate 37 can rotate relative to the lower plate 35. The lower plate 35 of the roller subassembly 36 is connected to the lower support 30 and is therefore fixed relative to the post 38, while the upper plate 37 of the roller subassembly 36 is free to rotate relative to the lower plate 35 and the post 38. To this end, the upper plate 37 defines a central hole 39 through which the post 38 extends. Of course, other roller configurations are also contemplated and could be included in the dispensing assembly 10 without departing from the spirit and scope of the present invention. In all instances, however, the roller subassembly 36 of the present invention is configured to support the weight of the roll of sheeting and to facilitate rotation of the roll while dispensing the sheeting, as further described below.

Referring still to FIGS. 1, 2, 4A, and 4B, in this exemplary embodiment, the dispensing assembly 10 further includes a caster 32 connected to the end of the lower member 24 of the main tube 20, which extends below the lower support 30. Although not expressly shown, it is preferred that the caster 32 is removably connected to the main tube 20 by a threaded shaft or otherwise, such that the distance of the caster 32 from the lower support 30 is adjustable.

Referring once again to FIGS. 1, 2, 3A and 3B, in this exemplary embodiment, another roller 46 is operably connected to the upper support 40, with the post 48 extending downward from the upper support 40 and through the roller 46. In some embodiments, the roller 46 at the upper support 40 is formed in substantially the same manner as the roller subassembly 36 at the lower support 30. However, during use, the upper support 40 and roller 46 typically will not be supporting the weight of the roll of sheeting, and therefore, in the exemplary embodiment, the roller 46 is a single plate that is mounted for rotation with respect to the upper support 40 and the post 48. Furthermore, in some embodiments, no roller is included at the upper support 40 at all.

Figure 5:
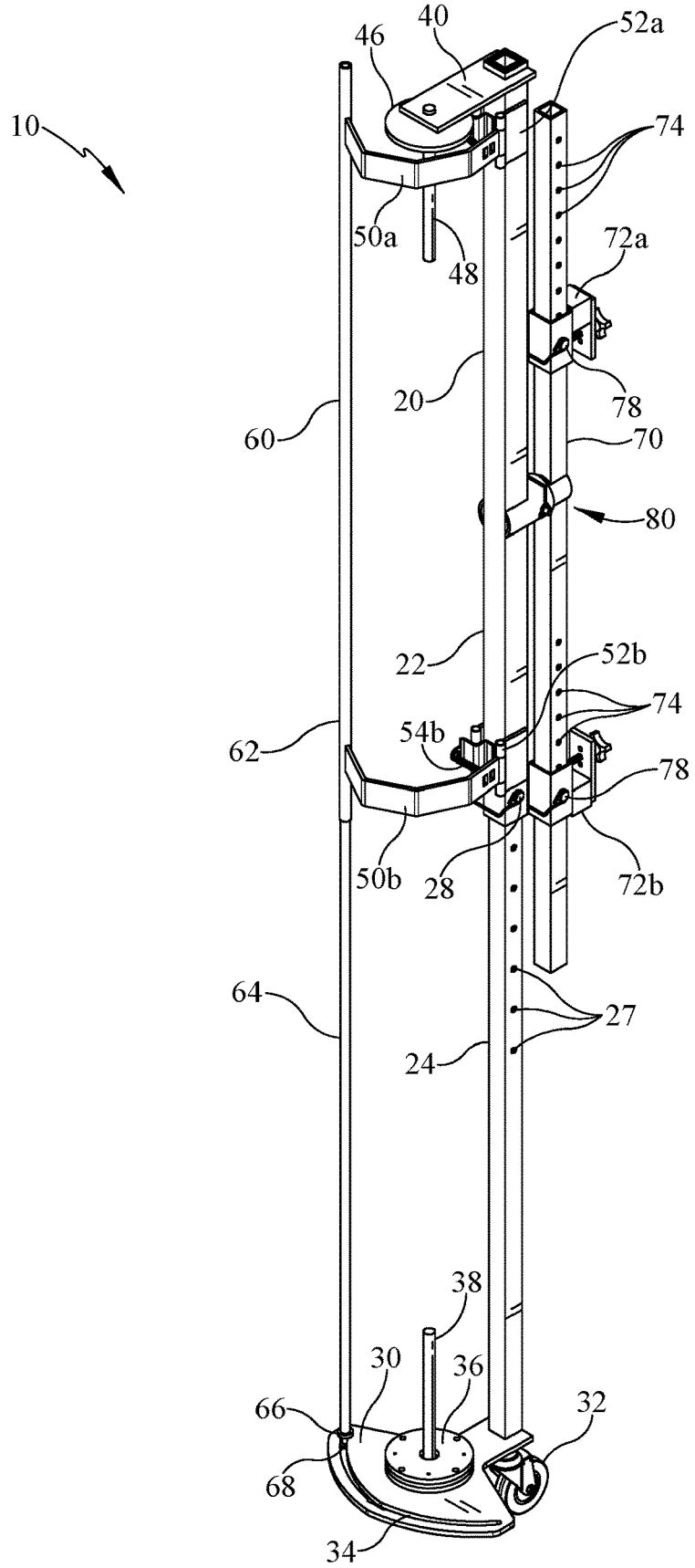
FIG. 5 is a front perspective view of the exemplary assembly of FIG. 1, but with the length of the securing rod and main tube extended.

Referring once again to FIGS. 1 and 2, but now also to FIG. 5, as briefly mentioned above, in this exemplary embodiment, the main tube 20 and the rod 60 each have an adjustable length. Furthermore, the lower support 30 is secured to the lower member 24 of the main tube 20, and the upper support 40 is secured to the upper member 22 of the main tube 20. As such, the distance between the lower support 30 and the upper support 40 is adjustable. With respect to the main tube 20, the lower member 24 of the main tube 20 is nested within and slides relative to the upper member 22 of the main tube 20. The lower member 24 of the main tube 20 further defines a plurality of adjustment holes 27 (shown in FIG. 5) along its length, and the upper member 22 of the main tube 20 defines a locking hole (not shown), such that a locking pin 28 is inserted through the locking hole of the upper member 22 of the main tube 20 and a selected one of the adjustment holes 27 of the lower member 24 of the main tube 20. The main tube 20 is therefore selectively maintained at a desired length, with the lower support 30 and the upper support 40 at a desired distance from one another. With respect to the rod 60, and similar to the main tube 20, the lower member 64 of the rod 60 is nested within and slides relative to the upper member 62 of the rod 60. The rod 60, however, does not include any adjustment holes, and so the length of the rod 60 is maintained through the connection of the upper member 62 of the rod 60 to the curved arms 50*a*, 50*b*, and the connection of the lower member 64 of the rod 60 to the lower support 30. That is to say, in this exemplary embodiment, the upper member 62 of the rod 60 is fixedly connected to the curved arms 50*a*, 50*b*, and, while the lower member 64 of the rod 60 is able to travel within the channel 34 of the lower support 30, the collars 66, 68 cause the lower member 64 of the rod 60 to move up and down with the lower support 30 when the length of the main tube 20 is adjusted.

As is perhaps best shown in FIGS. 3A and 3B, in this exemplary embodiment, the lower member 24 of the main tube 20 and the lower member 64 of the rod 60 each have a length such that, when the dispensing assembly 10 is configured for a relatively small distance between the lower support 30 and the upper support 40, such as is shown in FIGS. 1 and 2, the lower member 24 of the main tube 20 extends all of the way through the upper member 22 of the main tube 20, and the lower member 64 of the rod 60 extends all of the way through the upper member 62 of the rod 60. However, as shown in FIG. 5, when the main tube 20 and the rod 60 are extended, this is not always the case. Likewise, in other embodiments, the lengths of the upper member 22 and/or the lower member 24 of the main tube 20, as well as the lengths of the upper member 62 and/or the lower member 64 of the rod 60, may be designed such that the lower members 24, 64 will not extend all of the way through the upper members 22, 62 under any circumstance.

Figure 6A:
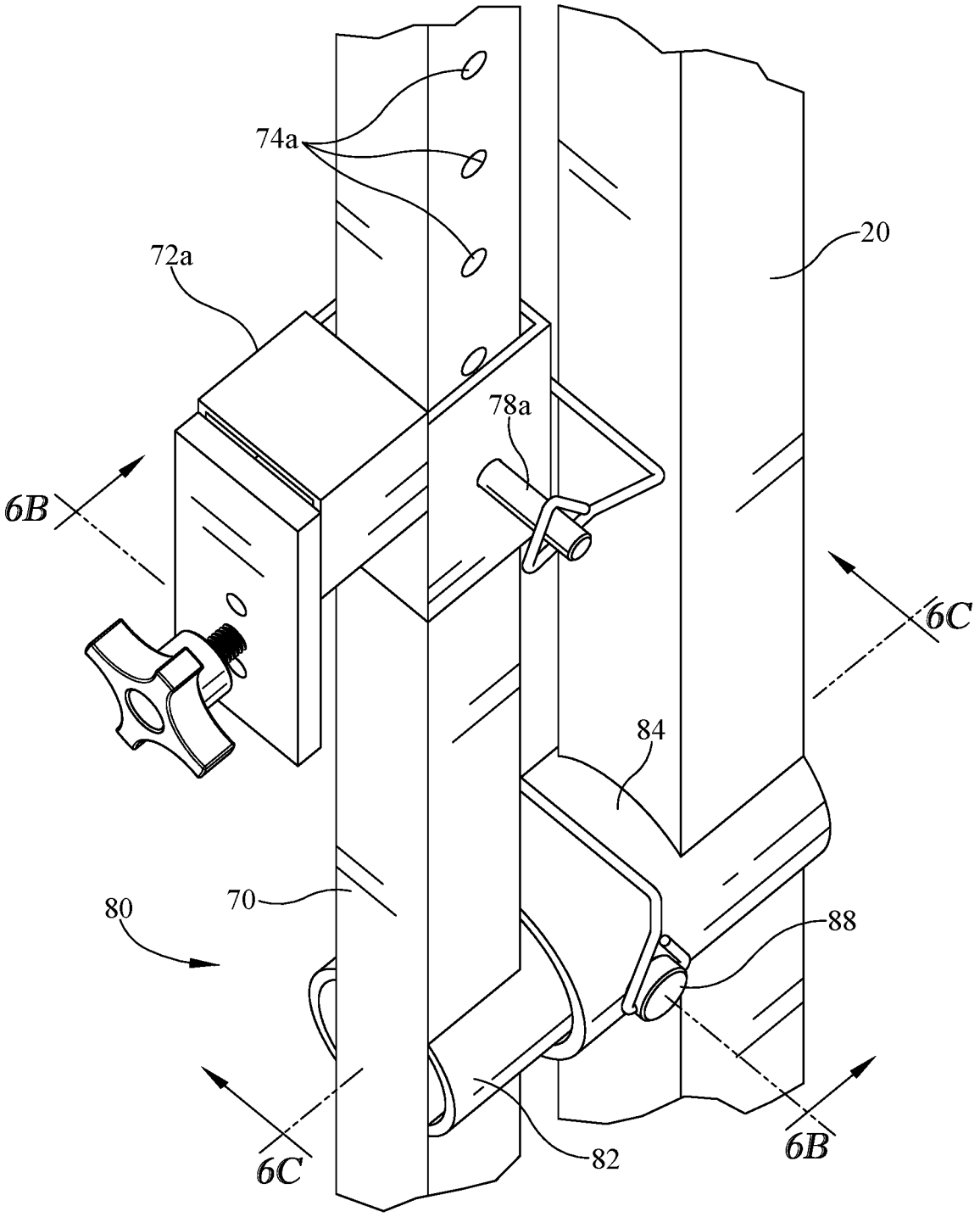
FIG. 6A is a partial enlarged view of a rotating connector of the exemplary assembly of FIG. 2.
Figure 6B:
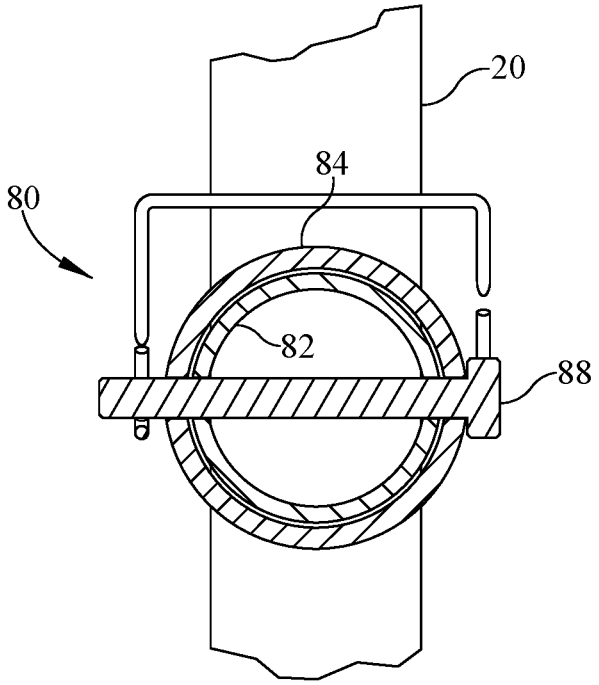
FIG. 6B is a cross-sectional view of the rotating connector taken along line 6B-6B of FIG. 6A.
Figure 6C:
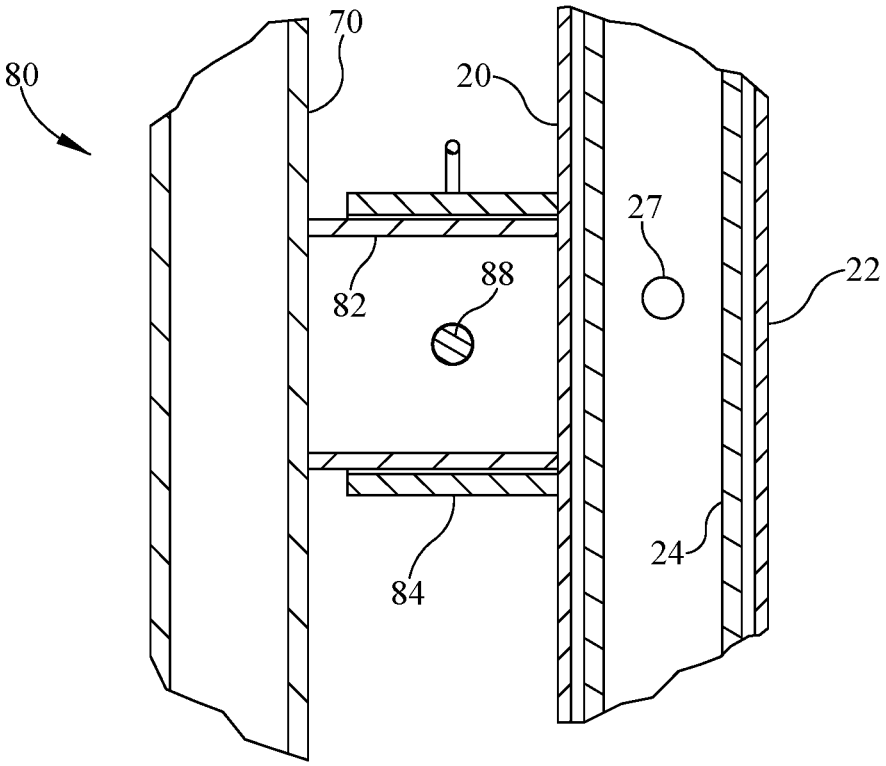
FIG. 6C is a cross-sectional view of the rotating connector taken along line 6C-6C of FIG. 6A.

Referring now to FIGS. 6A-6C, in this exemplary embodiment, the knuckle 80 connecting the main tube 20 and the connection tube 70 comprises: an inner tube 82 extending substantially perpendicularly from the connection tube 70; and an outer tube 84 extending substantially perpendicularly from the main tube 20. The inner tube 82 is nested within the outer tube 84, and the inner tube 82 can rotate relative to the outer tube 84. When the connection tube 70 and the main tube 20 are aligned and extend substantially parallel to one another, such as is shown in FIGS. 6A-6C, alignment holes defined in the inner tube 82 and the outer tube 84 are aligned, and a locking pin 88 is inserted to secure the inner tube 82 to the outer tube 84, thus maintaining the orientation of the connection tube 70 and the main tube 20 relative to one another. Upon removing the locking pin 88, the main tube 20 is free to rotate relative to the connection tube 70, for example, to allow for storage, loading/unloading of the roll of sheeting, or to provide for application of the sheeting to a sloped roof, as further described below.

Referring now to FIGS. 1, 2, and 6A, in this exemplary embodiment, the connection tube 70 also defines multiple adjustment holes 74*a*, 74*b*. First and second clamps 72*a*, 72*b* are slidably connected to the connection tube 70, and each clamp 72*a*, 72*b* is configured to be selectively secured to the connection tube 70 via one or more of the multiple adjustment holes 74*a*, 74*b* by a locking pin 78*a*, 78*b*. Although two clamps 72*a*, 72*b* are included in this exemplary embodiment, fewer (one) or more clamps could be incorporated into the dispensing assembly 10 without departing from the spirit and scope of the present invention.

Figure 7:
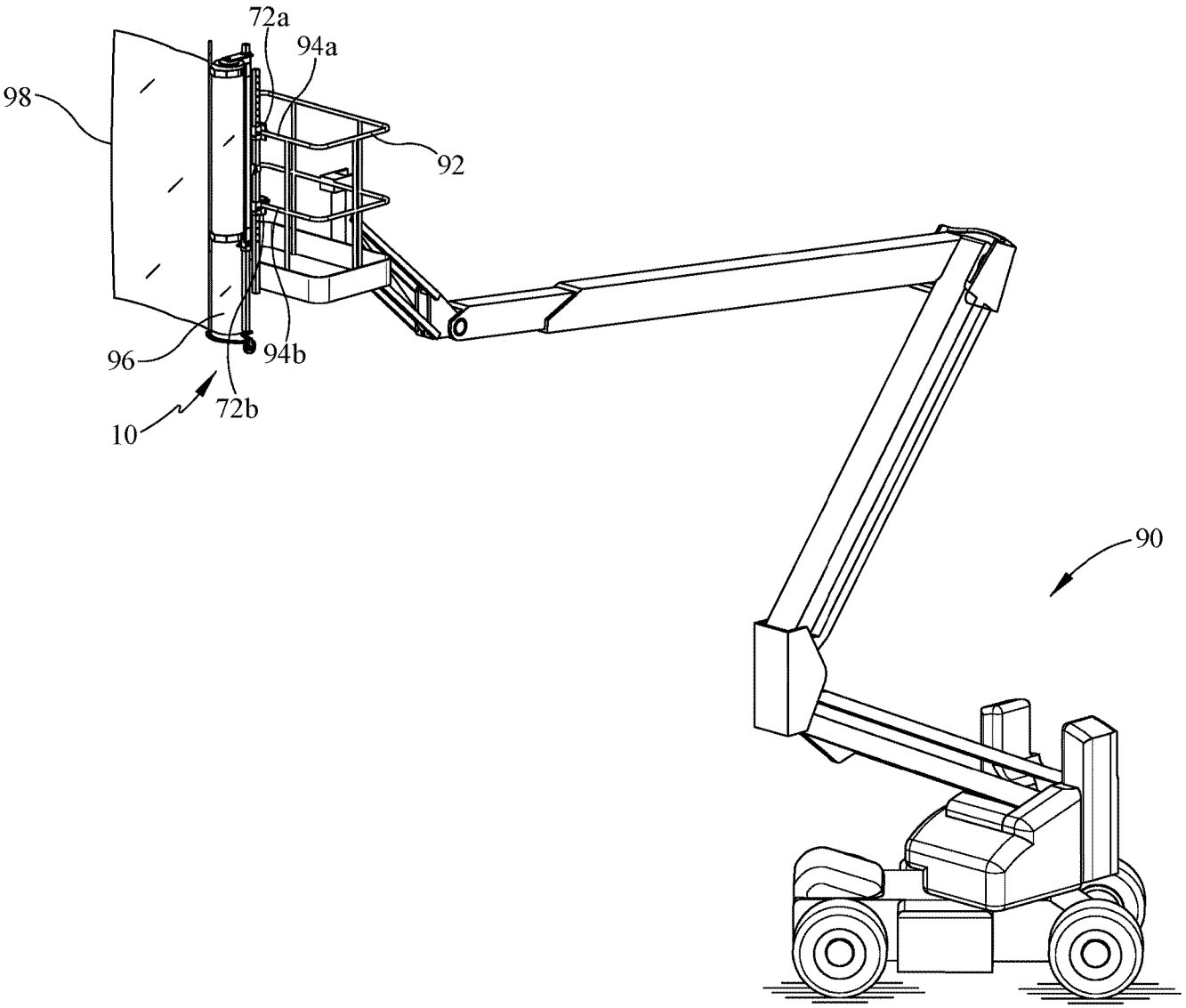
FIG. 7 is a perspective view of the exemplary assembly of FIG. 1 in use and attached to a vehicle for dispensing sheeting from a roll.

In operation, and referring now to FIGS. 1, 2, 5, and 7, a user first attaches the dispensing assembly 10 to a cherry picker 90 or similar vehicle by adjusting the position of each of the clamps 72*a*, 72*b* as described above, i.e., by way of the adjustment holes 74*a*, 74*b* and the locking pins 78*a*, 78*b*. In particular, according to one exemplary implementation and as shown in FIG. 7, each clamp 72*a*, 72*b* is positioned adjacent to one of the bars 94*a*, 94*b* forming the cage 92 of the platform of the cherry picker 90. The clamps 72*a* 72*b* are then fastened to the bars 94*a*, 94*b*, thus securing the dispensing assembly 10 to the cherry picker 90. Of course, alternative means of attaching the dispensing assembly of the present invention are contemplated, depending on the particular vehicle or machine being used.

Once the dispensing assembly 10 is attached, a roll 96 of sheeting 98 is then inserted into the dispensing assembly 10. In particular, the lower member 24 of the main tube 20 is released from the upper member 22 of the main tube 20, allowing the main tube 20 to expand to a length greater than the length of the roll 96; in other words, the distance between the lower support 30 and the upper support 40 is greater than the length of the roll 96. The adjustable length of the main tube 20 not only facilitates loading of the roll 96, but also allows for different widths of materials to be used with the dispensing assembly 10 of the present invention. The roll 96 is then positioned on the roller subassembly 36 of the lower support 30, with the post 38 at the lower support 30 extending upward and into the center of the roll 96, and with the top of the roll 96 aligned with the post 48 extending from the upper support 40.

Next, the roller 46 of the upper support is moved into engagement with the other end of the roll 96, with the post 48 extending downward and into the center of the roll 96, through the movement of the upper member 22 of the main tube 20 relative to the lower member of the main tube 20. The locking pin 28 is then inserted to secure the lower member 24 of the main tube 20 relative to the upper member 22 of the main tube 20. The roll 96 of sheeting 98 is now supported by the lower support 30, with the roll resting on the roller subassembly 36, and the posts 38, 48 preventing removal of the roll 96. Furthermore, and as shown in FIG. 7, the springs 54*a*, 54*b* provide a biasing force to move the curved arms 50*a*, 50*b* and the rod 60 toward the closed position to partially surround or enclose the roll 96, with the rod 60 engaging the roll 96 along its length.

To dispense the sheeting 98, for example, to a wall of a building, the dispensing assembly 10 is raised to the appropriate height adjacent to the wall, and the free end of the sheeting 98 is affixed to the wall. The dispensing assembly 10 is then moved laterally along the wall, thus allowing the sheeting 98 to dispense. For example, in some implementations, the cherry picker 90 is driven alongside the wall, while in other implementations, the cage 92 is operated so as to move the cage 92 alongside the wall.

In any event, as the dispensing assembly 10 is moved away from the affixed end of the sheeting 98, the roller subassembly 36 allows the roll 96 of sheeting 98 to rotate within the dispensing assembly 10, while dispensing additional sheeting 98 from the roll 96. To this end, the springs 54*a*, 54*b* of the curved arms 50*a*, 50*b* provide a biasing force to maintain the curved arms 50*a*, 50*b* and the rod 60 next to the roll 96 of sheeting 98 to control the dispensing of the sheeting 98. As such, the curved arms 50*a*, 50*b* and the rod 60 prevent the sheeting 98 from unintentionally unwinding from the roll 96 due to high winds, gravity, or the like, but still allow the roll 96 to rotate and dispense sheeting 98 as described above.

In some implementations, the insertion of the roll 96 of sheeting 98 is facilitated by first releasing the locking pin 88 of the knuckle 80 and allowing the main tube 20 to rotate relative to the connection tube 70. In particular, the main tube 20 can be rotated substantially parallel to the ground to install the roll 96 of sheeting 98. Once the roll 96 of sheeting 98 is installed, the main tube 20 is rotated back substantially parallel to the connection tube 70, and the locking pin 88 is inserted to secure the main tube 20 to the connection tube 70. A similar operation can be performed in order to place the cage 92 of the cherry picker 90 on or near the ground when the dispensing assembly 10 is still attached. Furthermore, it is contemplated that, in some implementations, such as applying sheeting to a sloped roof, it is beneficial to leave the locking pin 88 out of the knuckle 80 to allow the main tube 20 to maintain an angle relative to the connection tube 70 during operation.

Although not shown, additional features and refinements are also contemplated. For example, in some embodiments of the present invention, keepers or other such removable connectors may be located at either end of the connection tube 70 to further secure the main tube 20 in an aligned configuration with the connection tube 70. Further still, in some embodiments, a pulley may be positioned at the top end of the main tube 20 to assist in adjusting the length of the main tube 20.

One of ordinary skill in the art will also recognize that additional embodiments and implementations are also possible without departing from the teachings of the present invention. This detailed description, and particularly the specific details of the exemplary embodiment and implementation disclosed therein, is given primarily for clarity of understanding, and no unnecessary limitations are to be understood therefrom, for modifications will become obvious to those skilled in the art upon reading this disclosure and may be made without departing from the spirit or scope of the present invention.

What is claimed is:

1. An assembly for dispensing sheeting from a roll, comprising:

a main tube;

a connection tube connected to the main tube, wherein the connection tube is configured to removably attach the assembly to a vehicle, and wherein the connection tube is pivotally connected to the main tube, such that the main tube can rotate relative to the connection tube;

a lower support secured to and extending from the main tube and configured to support the roll, such that, in use, the roll can rotate while sheeting is dispensed from the roll; and one or more arms pivotally connected to the main tube and configured to partially enclose the roll when it is supported by the lower support;

wherein the connection tube is pivotally connected to the main tube by a knuckle comprising: an inner tube extending substantially perpendicularly from one of the connection tube or the main tube; and an outer tube extending substantially perpendicularly from the other of the connection tube or the main tube, with the inner tube nested within the outer tube, such that the inner tube can rotate relative to the outer tube.

2. The assembly of claim 1, wherein the main tube has an adjustable length.

3. The assembly of claim 2, wherein the main tube includes a first member and a second member, wherein the second member is nested within and slides relative to the first member, and wherein with the lower support extends from a lower end of the second member.

4. The assembly of claim 1, and further comprising a post extending upward from the lower support, such that, when the roll is supported by the lower support, the post is positioned within the roll.

5. The assembly of claim 4, and further comprising an upper support secured to and extending from the main tube at a distance from the lower support, with a post extending downward from the upper support, such that, when the roll is supported by the lower support, the post is positioned within the roll.

6. The assembly of claim 1, and further comprising a roller subassembly operably connected to the lower support, such that, in use, the roll is positioned on the roller subassembly.

7. The assembly of claim 1, and further comprising one or more springs that provide a biasing force to move the one or more arms toward a closed position.

8. The assembly of claim 7, and further comprising a securing member connected to each of the one or more arms, the securing member extending substantially parallel to the main tube and configured to engage the roll along its length.

9. The assembly of claim 1, and further comprising one or more clamps slidably connected to the connection tube, the one or more clamps configured to fasten to a portion of the vehicle to attach the assembly to the vehicle.

10. The assembly of claim 1, and further comprising a locking pin to selectively secure the inner tube to the outer tube of the knuckle, thus maintaining the orientation of the connection tube and the main tube relative to one another.

11. An assembly for dispensing sheeting from a roll, comprising:

a main tube;

a connection tube pivotally connected to the main tube, such that the main tube can rotate relative to the connection tube;

one or more clamps connected to the connection tube;

a lower support extending from the main tube and configured to support the roll;

an upper support extending from the main tube at a distance from the lower support; and a securing member pivotally connected to the main tube;

wherein the lower support and the upper support hold the roll substantially parallel to the main tube, and wherein the securing member engages the roll along its length; and wherein the connection tube is pivotally connected to the main tube by a knuckle comprising: an inner tube extending substantially perpendicularly from one of the connection tube or the main tube; and an outer tube extending substantially perpendicularly from the other of the connection tube or the main tube, with the inner tube nested within the outer tube, such that the inner tube can rotate relative to the outer tube.

12. The assembly of claim 11, and further comprising one or more curved arms connecting the securing member to the main tube, along with one or more springs that provide a biasing force to move the one or more curved arms toward a closed position.

13. The assembly of claim 11, wherein the main tube includes a first member and a second member, wherein the second member is nested within and slides relative to the first member, wherein the upper support is secured to and extends from an upper end of the first member, and wherein the lower support is secured to and extends from a lower end of the second member.

14. The assembly of claim 11, and further comprising a post extending upward from the lower support and a post extending downward from the upper support, such that, when the roll is held substantially parallel to the main tube, the posts are positioned within the roll.

15. The assembly of claim 11, and further comprising a roller subassembly operably connected to the lower support, wherein, when the roll is held substantially parallel to the main tube, the roll is positioned on the roller subassembly and can rotate while sheeting is dispensed from the roll.

16. The assembly of claim 11, and further comprising a locking pin to selectively secure the inner tube to the outer tube of the knuckle, thus maintaining the orientation of the connection tube and the main tube relative to one another.

17. The assembly of claim 11, wherein the one or more clamps are slidably connected to the connection tube.

18. The assembly of claim 17, wherein the connection tube defines multiple adjustment holes, and each clamp of the one or more clamps is selectively secured to the connection tube via a selected one of the multiple adjustment holes by a locking pin.

* * * * *